United States Patent [19]

McDonald

[11] Patent Number: 4,563,923

[45] Date of Patent: Jan. 14, 1986

[54] IMPACT TOOL

[75] Inventor: Douglas A. McDonald, Thornleigh, Australia

[73] Assignee: Rotopack Tools Pty. Limited, Sydney, Australia

[21] Appl. No.: 523,360

[22] Filed: Aug. 15, 1983

Related U.S. Application Data

[63] Continuation-in-part of Ser. No. 370,247, Apr. 20, 1982, abandoned.

[30] Foreign Application Priority Data

Mar. 30, 1983 [AU] Australia ..... PF8698

[51] Int. Cl.[4] ..... B25B 19/00

[52] U.S. Cl. ..... 81/466

[58] Field of Search ..... 81/465, 466, 463; 173/93, 94, 97

[56] References Cited

U.S. PATENT DOCUMENTS

| | | | |
|---|---|---|---|
| 2,247,521 | 7/1941 | Pierce | 81/465 |
| 3,158,050 | 11/1964 | Shandel | 81/466 |
| 3,831,468 | 8/1974 | Miller | 81/466 |

*Primary Examiner*—James L. Jones, Jr.

*Attorney, Agent, or Firm*—Lowe, King, Price & Becker

[57] ABSTRACT

An improved impact tool is disclosed for application of impact torque. The described tool comprises a shaft defining an axis for rotation of the tool. The impact tool includes a transversely extending striker bar mounted for rotation about the axis, one or more anvils connected to the shaft and mounted in the path of the striker bar, and a pair of spaced parallel plates connected to the shaft and between which the anvil or anvils are mounted. Preferably, the plates are circular and are mounted eccentrically with respect to the shaft.

11 Claims, 8 Drawing Figures

IMPACT TOOL

CROSS REFERENCE TO RELATED APPLICATION

This application is a continuation-in-part of applicant's earlier filed copending application Ser. No. 370,247, filed Apr. 20, 1982, now abandoned, for IMPACT TOOL, and incorporated herein by reference.

BACKGROUND OF THE INVENTION

The present invention relates to hand-tools and in particular to a tool which enables the user to apply impact torque, for example, to loosen an automotive wheel nut. The invention will be described hereinafter with reference to this field of use. It will be appreciated, however, that the invention is not limited to this particular application.

It is frequently found that standard sized wrenches do not provide sufficient leverage to loosen stubborn nuts, bolts or large screws. This is particularly the case with automotive road tools which are often inadequately sized for reasons of space and cost. To provide increased torque, the user may resort to attaching makeshift extension levers or to striking the wrench with a hammer. This is always awkward and usually damages both the tool and the bolt-head, nut or screw.

SUMMARY AND OBJECTS OF THE INVENTION

It is an object of the present invention to provide an impact tool which can be used to apply an impact torque to whatever operative tool is connected thereto.

It is another object of the invention to provide an impact tool with protective structure for protecting the fingers of a user from being pinched during operation.

Still another object of the invention is to provide a protective structure in an impact tool with reduced size requirement for efficient material utilization.

According to one broad form of the invention, as presently contemplated, there is provided an impact tool for applying impact torque comprising a pair of spaced parallel plates, a striker bar located between said plates and mounted for rotation about an axis, at least one anvil member extending between said plates and spaced from said axis in the path of said striker bar, handle means connected with said plates extending on one side thereof, and transfer means, connected with said plates extending away from said handle means and adapted to transmit impact torque.

Preferably, the handle and transfer means extend along the axis and the plates are circular discs having a center spaced away from the axis.

Preferably, the transfer means is mounted for connection to a wrench socket fitting, thereby making the device generally applicable to a wide range of operative tools.

BRIEF DESCRIPTION OF THE DRAWINGS

A preferred embodiment of the invention will now be described, by way of example only, with reference to the accompanying drawings in which.

DETAILED DESCRIPTION OF A PREFERRED EMBODIMENT

Figure 1:
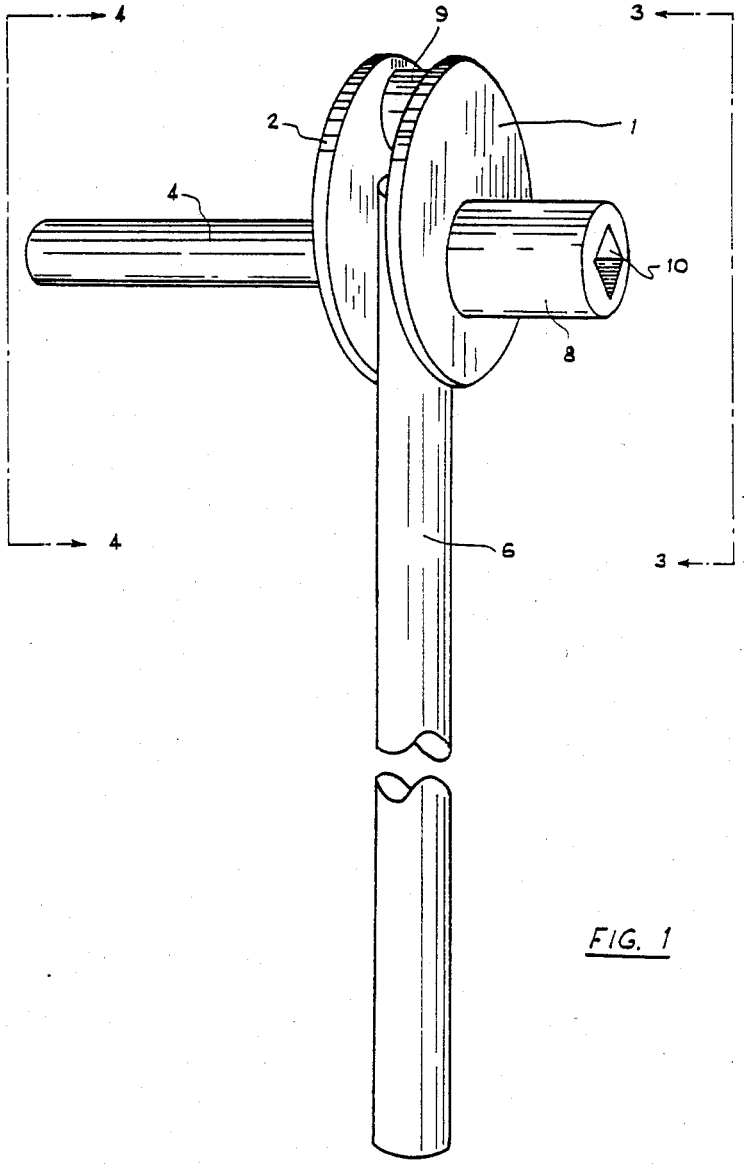
FIG. 1 is a perspective view of the invention.
Figure 2:
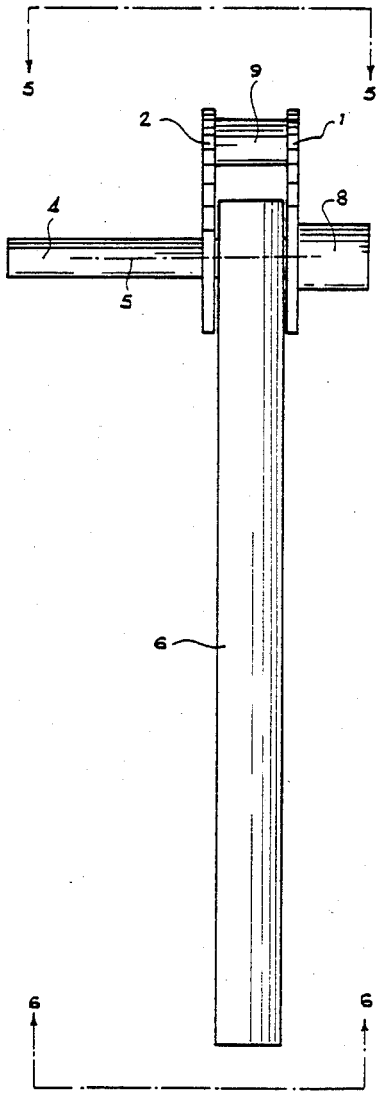
FIG. 2 is a side elevation thereof.
Figure 4:
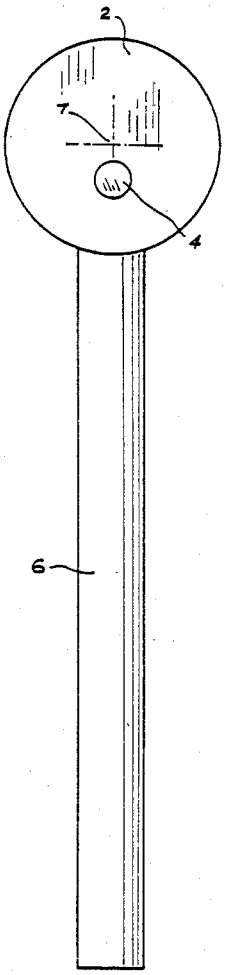
FIG. 4 is a rear view thereof as seen along lines 4—4 in FIG. 1.
Figure 5:
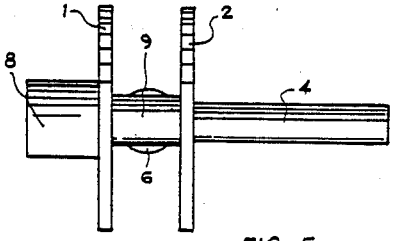
FIG. 5 is a top view thereof as seen along lines 5—5 in FIG. 2.
Figure 6:
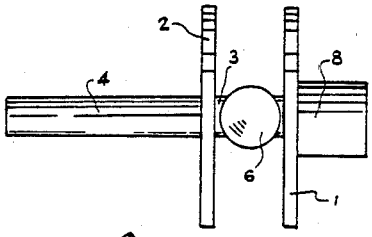
FIG. 6 is a bottom view thereof as seen along lines 6—6 in FIG. 2.

Referring now to FIG. 1, the impact tool as shown in perspective therein includes a pair of spaced parallel plates 1 and 2 in the form of discs on a common axis which need not, but may be, welded to a shaft 3 shown in FIGS. 2 and 6. The shaft extends through the discs to define a handle 4 and an axis of rotation 5, also seen in FIG. 2, for a striker bar 6 which is mounted for rotation about the shaft 3 between the two plates 1 and 2. The two plates in the form of spaced circular discs preferably have their centers 7 displaced from the axis 5, as shown in FIG. 4.

Located coaxially with respect to the shaft 3 is a socket 8 which is preferably welded to the plate 1 and extends along the axis 5 in a direction opposite to that of the handle 4. Of course, a further shaft may extend from plate 1 and socket 8 may instead be releasably or permanently mounted thereto. An anvil member 9 extends between the plates and is located in the path of the striker bar at a position spaced from the axis 5.

Figure 3:
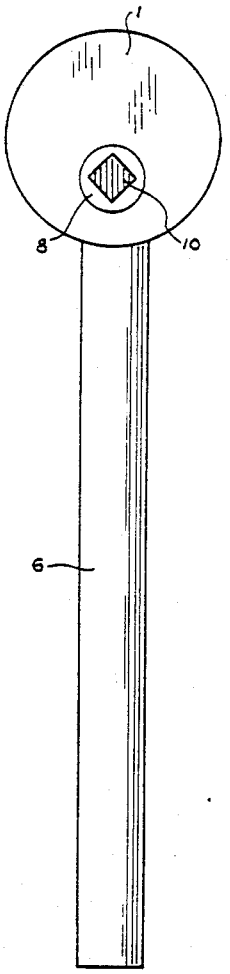
FIG. 3 is a front view thereof as seen along lines 3—3 in FIG. 1.

As may be seen with reference to FIG. 3, the socket 8 includes a square sectioned recess 10 for engaging any desired tool or fitting to which impact torque is to be applied. For example it may be used in conjunction with an extension bar (not shown) for subsequent engagement with a conventional tool socket, also not shown. Alternatively, the socket 8 may be replaced by any other means to transfer impact torque to a bolt, screw or other required item.

In operation as an impact wrench to loosen an overtightened nut, for example, the socket 8 is connected to the nut either directly or through such intermediate sockets and extension pieces as may be required. The user then grips the handle 4 with one hand and with the other brings the striker bar down sharply against the appropriate side of the anvil member, thereby to deliver a substantial impact torque through the socket 8 to the nut. Preferably, the striker bar is as heavy as conveniently possible in order to provide a high moment of inertia. The handle 4 may also be provided with a suitable rubber grip or other covering for ease of operation.

It will be appreciated that the preferred provision of circular discs for the spaced parallel plates ensures that the operator's fingers cannot easily be injured by being caught between the anvil and striker bar, since the discs prevent the fingers from touching the anvil. That is, direct contact between the fingers and the appropriate side of the anvil member is prevented. Furthermore, the displacement of the disc center 7 from the axis 5 produces a geometry which tends to remove from the system any item coming between the discs and the striker bar as it moves towards the anvil. That is to say, the angle between the striker bar and a tangent to the discs at the scissor point remains obtuse as the striker bar nears the anvil.

Moreover, displacement of axis 5 from center 7 of the discs increases the distance between axis 5 and anvil 9. Thus, the moment arm provided to force exerted against anvil 9 is increased with respect to axis 5 of socket 8. The eccentric positioning of the discs with respect to the axis thus provides an improved mechanical advantage to the structure which can otherwise only be achieved by the use of larger discs having a center coincident with the axis of rotation. Thus, costs of materials required to fabricate the inventive tool for a desired torque transmitting capability are reduced.

As will also be appreciated, the increased distance between axis 5 and anvil 9 reduces the stress on the anvil and on the welded connection therebetween and the discs. Thus, smaller discs may be used with a capability of withstanding increased torque application without being subjected to increased operational stresses.

Although the invention has been described with reference to a specific example, it will be appreciated by those skilled in the art that the inventive concept may be embodied in many other forms.

Figure 7:
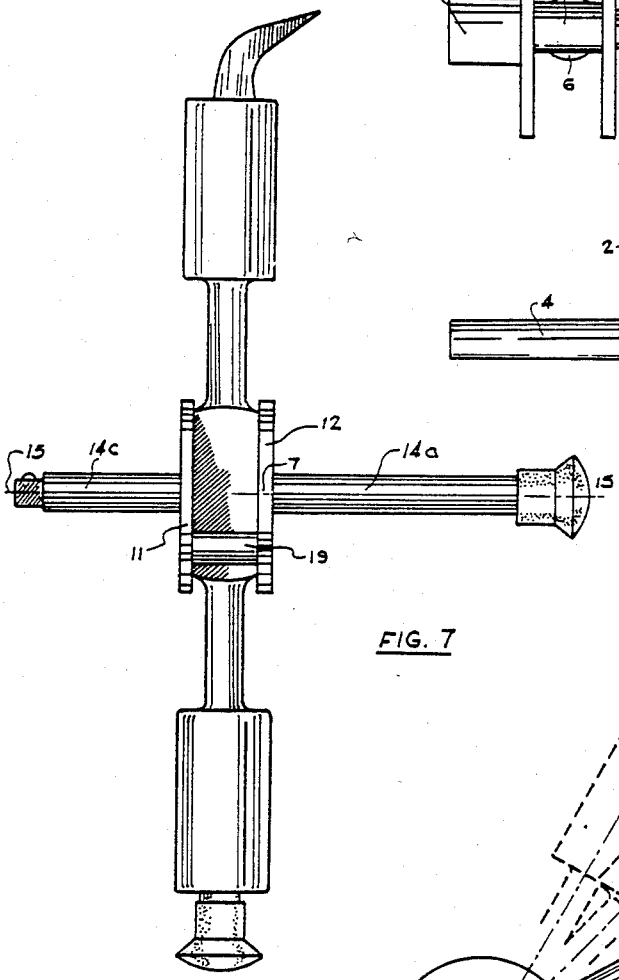
FIG. 7 shows an alternate embodiment of the invention.
Figure 8:
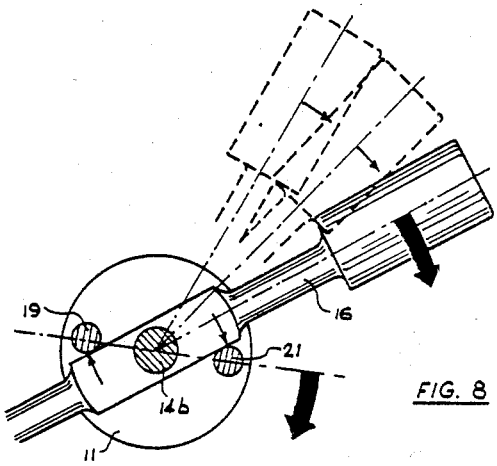
FIG. 8 illustrates operation of the alternate embodiment.

For example, as shown in FIGS. 7 and 8, the invention may be practiced with a pair of discs 11 and 12 having an axis 17 coincident with the axis of rotation 15 of a shaft 14. The shaft 14 may extend through discs 11 and 12 or may comprise three separate sections 14*a*, 14*b*, and 14*c*, each welded to the discs as shown. Shaft section 14*c* may be provided with a mounting structure for a socket or other torque applying device.

In the modified form of the invention, two anvils 19 and 21 may be provided. The anvils may be equally spaced from axis 15. Various implements may be provided in conjunction with the present tool structure. A wedge, or crowbar, for example, may be provided at the end of the striker bar as shown in FIG. 7, and weights may be added thereto to increase the output torque of the tool.

As shown in FIG. 8, in operation striker bar 16 is sharply rotated against anvils 19 and 21, thereby to rotate disc 11 welded thereto. Disc 11 imparts torque to the output shaft 14*c* when force is applied by the striker bar to the anvils upon impact therewith, thereby providing the desired torque to the member to be driven by the tool.

The foregoing description of preferred embodiments of the invention is presented for purposes of illustration and description, and is not intended to be exhaustive or to limit the invention to the precise forms disclosed, since many additional modifications and variations are possible in light of the above teaching.

The embodiments were chosen and described in order best to explain the principles of the invention and its practical application, thereby to enable others skilled in the art to utilize the invention in various embodiments and with various modifications as are suited to the particular use contemplated. All such modifications and variations are within the scope of the invention as determined by the appended claims and interpreted in accordance with the breadth to which they are fairly, legally and equitably entitled.

I claim:

1. An impact tool for applying impact torque comprising:

a shaft defining an axis, a transversely extending striker bar mounted for rotation about said axis, at least one anvil member connected to said shaft and spaced from said axis in the path of said striker bar, said at least one anvil member extending between a pair of spaced, parallel circular discs extending normally with respect to said axis, said shaft intersecting said discs and defining a center of rotation for said impact tool at the intersection, said circular discs having centers displaced from the intersection of said shaft therewith, said at least one anvil member eccentrically located with respect to said centers of said circular discs thereby providing an eccentric structure to said tool.

2. Power-factor regulating apparatus comprising:

a delta connected circuit which comprises three series circuits, each of the series circuits connected in parallel with a phase of a distribution line and including:

a parallel circuit composed of a diode and a thyristor connected in parallel, at which the polarities of said diode and said thyristor are reversed, a condenser, and a reactor as wave reformer, connected in series, and control means for preliminarily charging said condenser to about maximal line voltage while a load is disconnected from said distribution line and thereafter for connecting said condenser to said distribution line by operation of said thyristor at the time the line voltage is at or around its maximum after said load is connected to said distribution line, wherein said control means includes gate signal generating means for providing a substantially constant signal voltage to a gate of said thyristor beginning at said time when the line voltage is at or around its maximum after said load is connected to said distribution line and terminating at a time when said load is disconnected from said distribution line.

3. A power-factor regulating apparatus comprising:

a delta connected circuit which includes three series circuits, each of said series circuits including a condenser connected in series with a circuit composed of a diode and thyristor connected in parallel, at which the polarities of said diode and said thyristor are reversed, connected in series and three series reactors which are respectively connected between a respective phase of said delta connected circuit and the distribution line, control means for preliminarily charging said condenser to about maximal line voltage while a load is disconnected from said distribution line and thereafter for connecting said condenser to said distribution line by operation of said thyristor at the time the line voltage is at or around its maximum after said load is connected to said distribution line, wherein said control means includes gate signal generating means for providing a substantially constant signal voltage to a gate of said thyristor beginning at said time when the line voltage is at or around its maximum after said load is connected to said distribution line and terminating at a time when said load is disconnected from said distribution line, said control means further including means for terminating connection of said condenser to said distribution line upon detection of a first line voltage maximum subsequent to disconnection of said load from said distribution line and for maintaining current flow in said condenser until detection of said first line voltage maximum subsequent to disconnection of said load from said distribution line.

4. An impact tool as recited in claim 1 wherein said spaced parallel circular discs are rigidly affixed to said shaft and extend normally with respect to said axis.

5. An impact tool as recited in claim 1 wherein said circular discs have a common axis.

6. An impact tool as recited in claim 1 wherein said at least one anvil member comprises a pair of anvil members oppositely spaced with respect to said axis.

7. An impact tool as recited in claim 6 wherein said anvil members are welded to said pair of circular discs.

8. An impact tool as recited in claim 1 wherein said at least one anvil member consists of a single anvil member.

9. An impact tool for applying impact torque, comprising:

a shaft defining an axis, a transversely extending striker bar mounted for rotation about said axis, at least one anvil member connected to said shaft and spaced from said axis in the path of said striker bar, transmitting means connected to said shaft for receiving torque from said at least one anvil member and for transmitting said torque to a utilization device, a pair of parallel circular plates transverse to said axis defined by said shaft and including said at least one anvil member therebetween, said circular plates including means for increasing impact torque provided to said shaft by said striker bar, said means for increasing impact torque comprising an eccentric arrangement between said circular plates and said axis defined by said shaft, wherein a connecting line between the centers of said circular plates is displaced from said axis defined by said shaft, said at least one anvil member being displaced from said connecting line, thereby increasing the moment arm for the impact applied to said at least one anvil member.

10. An impact tool as recited in claim 9 wherein said spaced parallel circular plates form a means for preventing operator injury and for preventing access to an area of contact between said at least one anvil member and said striker bar.

11. An impact tool as recited in claim 9 wherein said at least one anvil member comprises a longitudinal element substantially parallel to said axis defined by said shaft and displaced therefrom.

* * * * *

UNITED STATES PATENT AND TRADEMARK OFFICE

CERTIFICATE OF CORRECTION

PATENT NO. : 4,563,923

DATED : January 14, 1986

INVENTOR(S) : Douglass A. McDonald

It is certified that error appears in the above-identified patent and that said Letters Patent is hereby corrected as shown below:

Column 4, delete lines 12-68

Column 5, delete lines 1-2 ;

Signed and Sealed this

*Thirteenth* Day of *May 1986*

[SEAL]

*Attest:*

DONALD J. QUIGG

*Attesting Officer*

*Commissioner of Patents and Trademarks*